United States Patent [19]

McJunkin, Jr. et al.

[11] Patent Number: 4,925,184

[45] Date of Patent: May 15, 1990

[54] BED-MOUNTABLE LEG EXERCISE DEVICE

[76] Inventors: Howard P. McJunkin, Jr., 862 Alta Road; David B. Gray, 1506 Chafton Road, both of Charleston, W. Va. 25314

[21] Appl. No.: 311,341

[22] Filed: Feb. 15, 1989

[51] Int. Cl.[5] ..... A63B 23/04

[52] U.S. Cl. ..... 272/73; 272/144; 272/900

[58] Field of Search ..... 272/73, 900, 144, DIG. 4, 272/145, 132; 128/25 R; 5/60, 62, 507, 508; 292/DIG. 5

[56] References Cited

U.S. PATENT DOCUMENTS

| | | | |
|---|---|---|---|
| 2,484,153 | 10/1949 | Chaudoir, Sr. | 272/73 |
| 2,673,088 | 3/1954 | Wentz | 272/73 |
| 3,622,153 | 11/1971 | Thompson | 272/73 |
| 3,848,870 | 11/1974 | Craig | 272/DIG. 4 |
| 3,910,571 | 10/1975 | Stenn | 272/73 |
| 4,169,591 | 10/1979 | Douglas | 272/144 |
| 4,227,739 | 10/1980 | Sorenson | 292/DIG. 5 |
| 4,390,177 | 6/1983 | Biran et al. | 272/900 |
| 4,515,361 | 5/1985 | Melillo et al. | 272/900 |
| 4,601,464 | 7/1986 | Mousel | 272/73 |
| 4,739,984 | 4/1988 | Dranselka | 272/73 |

*Primary Examiner*—Stephen R. Crow

*Attorney, Agent, or Firm*—Cushman, Darby & Cushman

[57] ABSTRACT

A cycle-like exercise device for enabling post operative exercise by a patient while in bed. The leg exercise device is mountable to a bedframe and has a pedal mounting structure extending upwardly therefrom. Pedals are rotatably mounted to the pedal mounting structure so that when a patient's feet are engaged with the pedals of the exercise device, cycle-like exercise of the patient's legs is possible.

18 Claims, 5 Drawing Sheets

42
44
40
26
38
46
44
40
20
10
22
42
30
36
34
24
36
34
44
44
12
28
54
18
14
16

BED-MOUNTABLE LEG EXERCISE DEVICE

BACKGROUND OF THE INVENTION

1. Field of the Invention

The present invention relates to leg exercise devices and, in particular, to a bicycle-type exerciser which is mountable to a bed so as to allow exercise of the legs.

2. Description of the Related Art

Following various types of surgery, assisted patient exercise such as therapeutic walks about the hall are often desirable to prevent blood clotting in the legs and to reduce fluid build up in the lungs as well as in the legs. However, facilities having limited nursing staffs are too time taxed to physically assist each patient in obtaining sufficient therapeutic post-operative exercise. It would therefore be desirable to provide a device which is readily accessible to the patient and can facilitate leg exercise to promote proper circulation, reduce fluid buildup, and possibly minimize the likelihood of blood clotting in the legs.

SUMMARY OF THE INVENTION

The present invention provides an exercise device for the post operative and/or bedridden patient which provides the desired post-operative exercise with minimal assistance of the nursing staff. Specifically, a bed-mountable leg exercise device is provided having a pair of cycle-like pedals mounted to a rigid frame which rigid frame is itself removably mountable to the frame of, for example, a hospital bed. In this manner, the leg exercise device can be quickly and easily mounted to a hospital bed by the nursing staff and, at the patient's leisure, the feet can be strapped to the pedals and a patient can exercise through a pedaling motion thereby enhancing circulation and minimizing post-operative complications.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
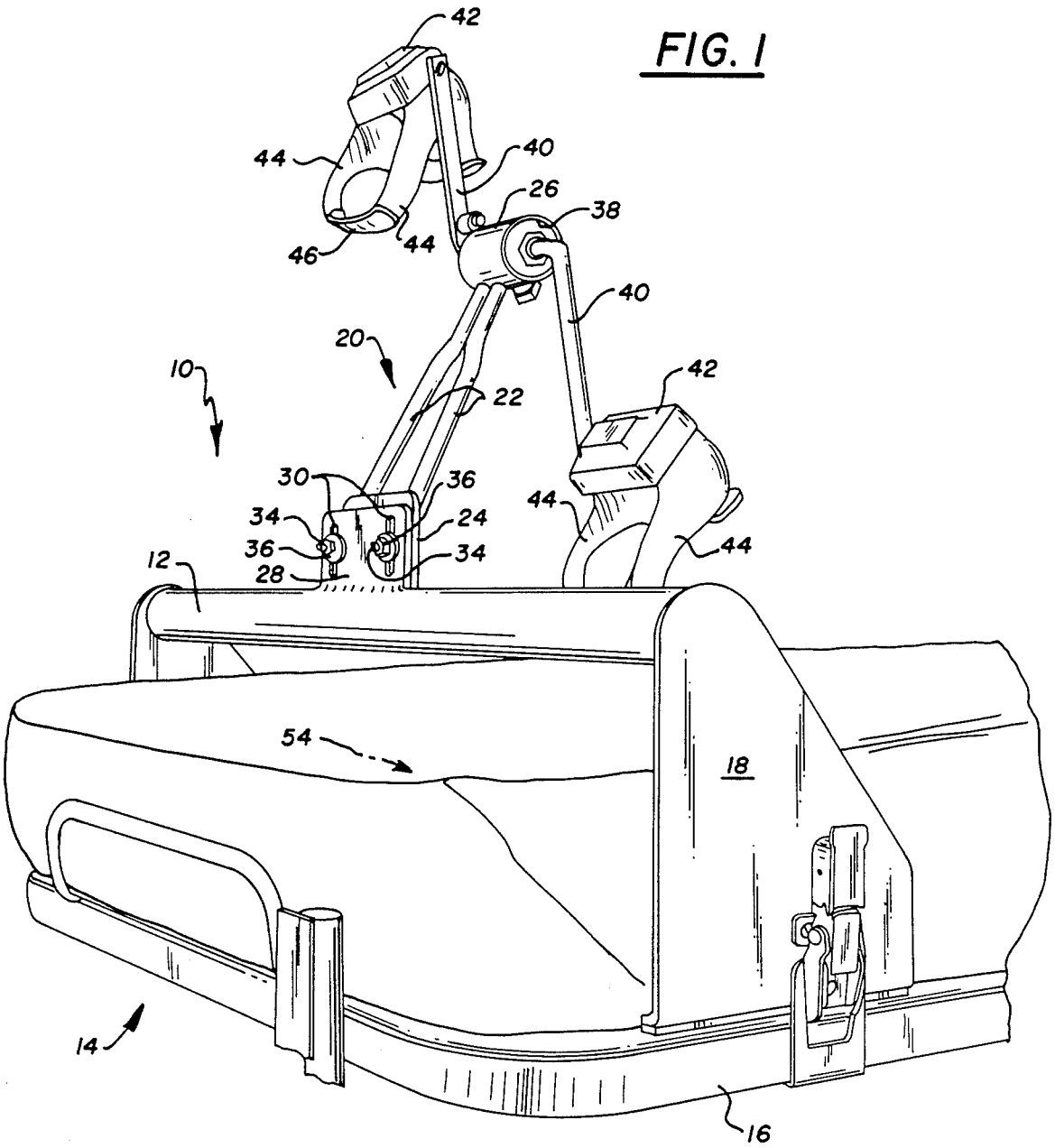
FIG. 1 is a perspective view of a bed-mountable leg exerciser provided in accordance with the present invention.

Referring to FIG. 1, the bed-mountable exercise device 10 provided in accordance with the present invention includes an elongated main body member 12 in the form of a rod which is adapted to be positioned transversely to the longitudinal axis of the bed 14 and mounted to the side rails 16 of the bed by mounting plates 18. Centrally of the main body member is a pedal mounting structure 20.

In the embodiment illustrated in FIG. 1. pedal mounting structure 20 includes first and second support rods 22, a base mounting plate 24 and a substantially cylindrical pedal axle receiving member 26. A flange 28 is defined on main body member 12 and has two or more apertures 30. Further, two or more screw receiving apertures (not shown) extend through base mounting plate 24. Thus, the pedal mounting structure can be mounted to the main body member 12 by passing screws 34 through apertures 30 and attaching nuts 36 thereto to couple base plate 24 to flange 28.

A pedal axle 38 is rotatably received in axle receiving member 26 and has first and second crank arms 40 coupled thereto. Pedal elements 42 are mounted to the distal ends of crank arms 40. A plurality of straps 44 are preferably fixedly mounted to the pedals 42 and are fastenable in pairs with hook and loop-type fasteners such as VELCRO®, buckles, snaps or the like, shown schematically at 46, to secure the patient's feet to each of the pedals 42. Preferably a pair of straps engages the instep and a pair of straps engages the heel of each foot.

Figure 2:
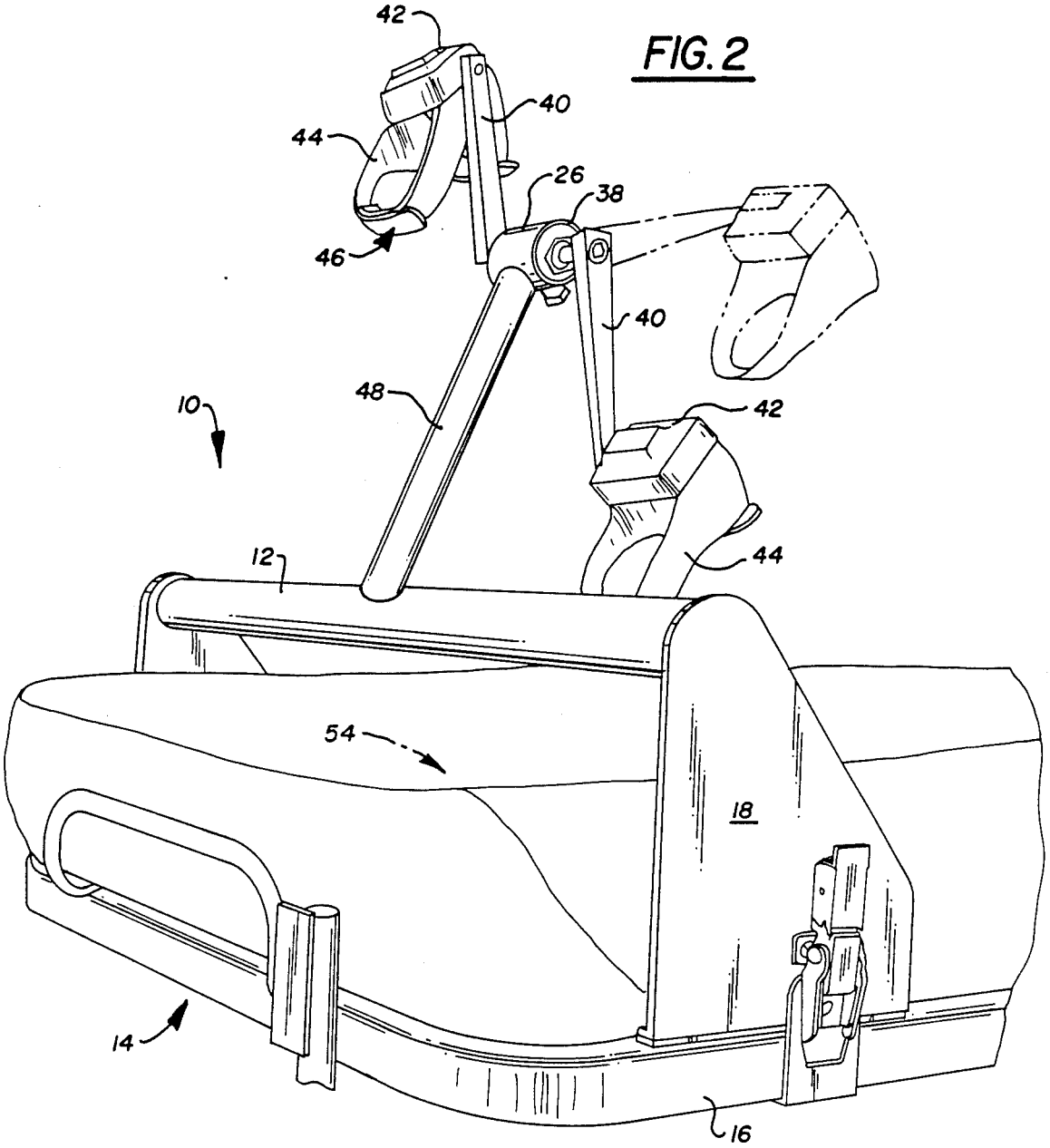
FIG. 2 is a perspective view of an alternate pedal mounting structure provided in accordance with the present invention.

As a further feature of the present invention, the crank arms 40 of pedals 42 may be indexed 90° apart, as shown in phantom lines in FIG. 2, rather than at the standard 180°. This arrangement would permit stroke victims to use their strong leg to in effect carry and exercise the leg suffering paralysis.

As can be seen in FIG. 2, in accordance with an alternate embodiment of the present invention, the pedal mounting structure can be a substantially cylindrical rod-like member 48 can be welded, for example, to the main body portion 12 of the leg exercise device 10. Such a rod 48 can be welded at a desired angle which minimizes leg elevation and maximizes the clearance of the foot and the heel relative to the bed and the main body member 12. This facilitates the use of the exercise device by recuperating patients and minimizes the likelihood of contact of the foot or a portion of the leg with the bar member 12 of the bed exercise device 10.

Figure 3:
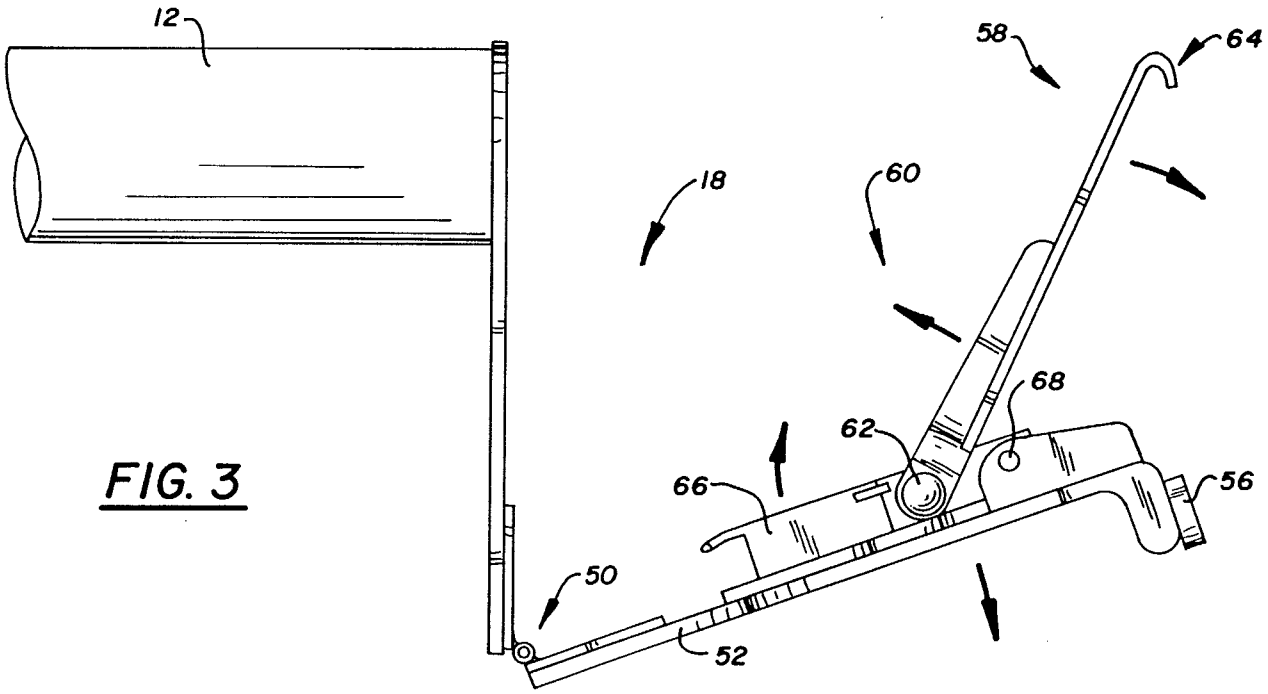
FIG. 3, is an elevational view, partly broken away for clarity, showing an alternate mounting plate provided in accordance with the present invention.
Figure 4:
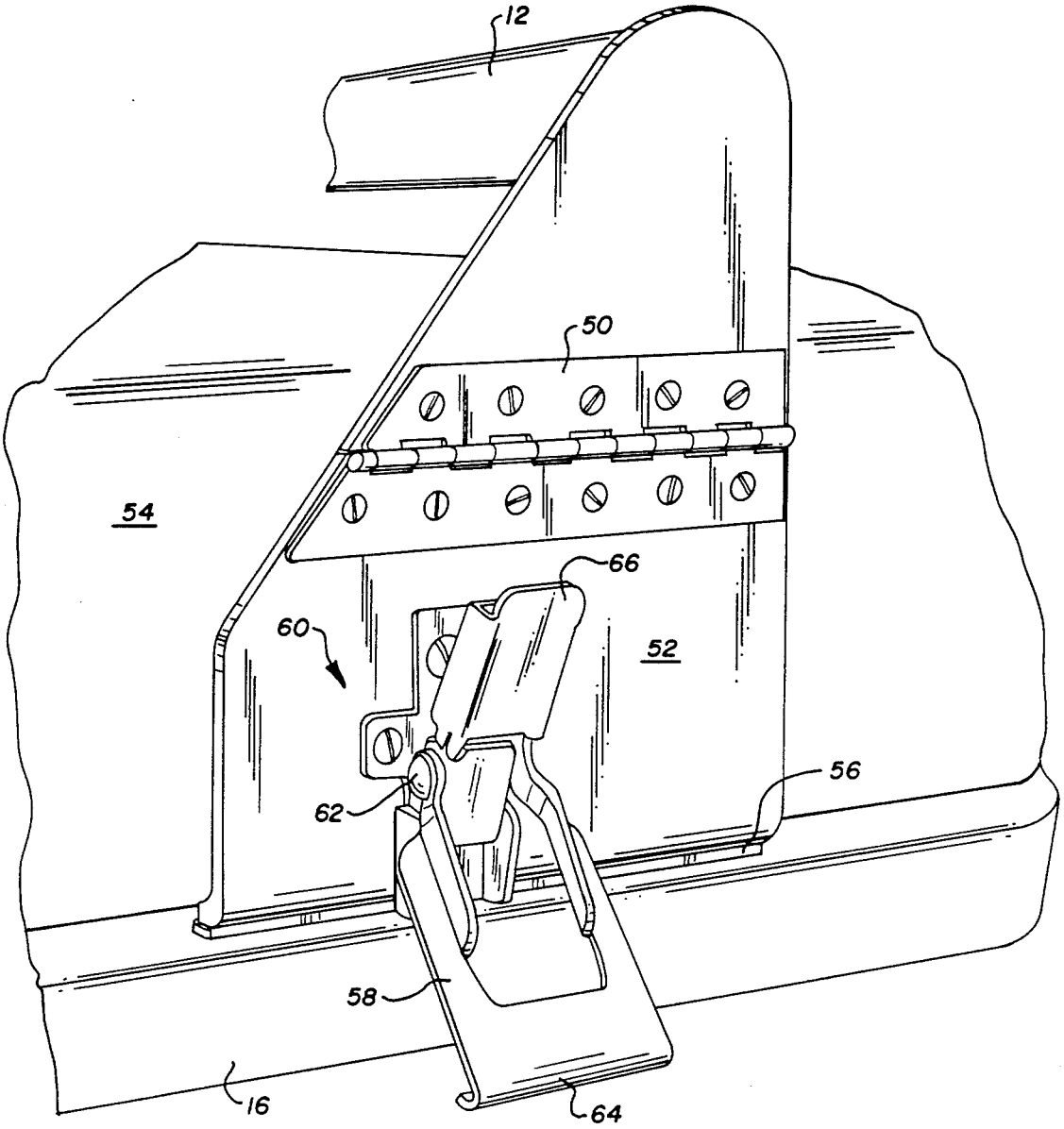
FIG. 4 is a perspective view of the mounting plate in accordance with the present invention disposed on the rail of a bed in its unlocked configuration.
Figure 5:
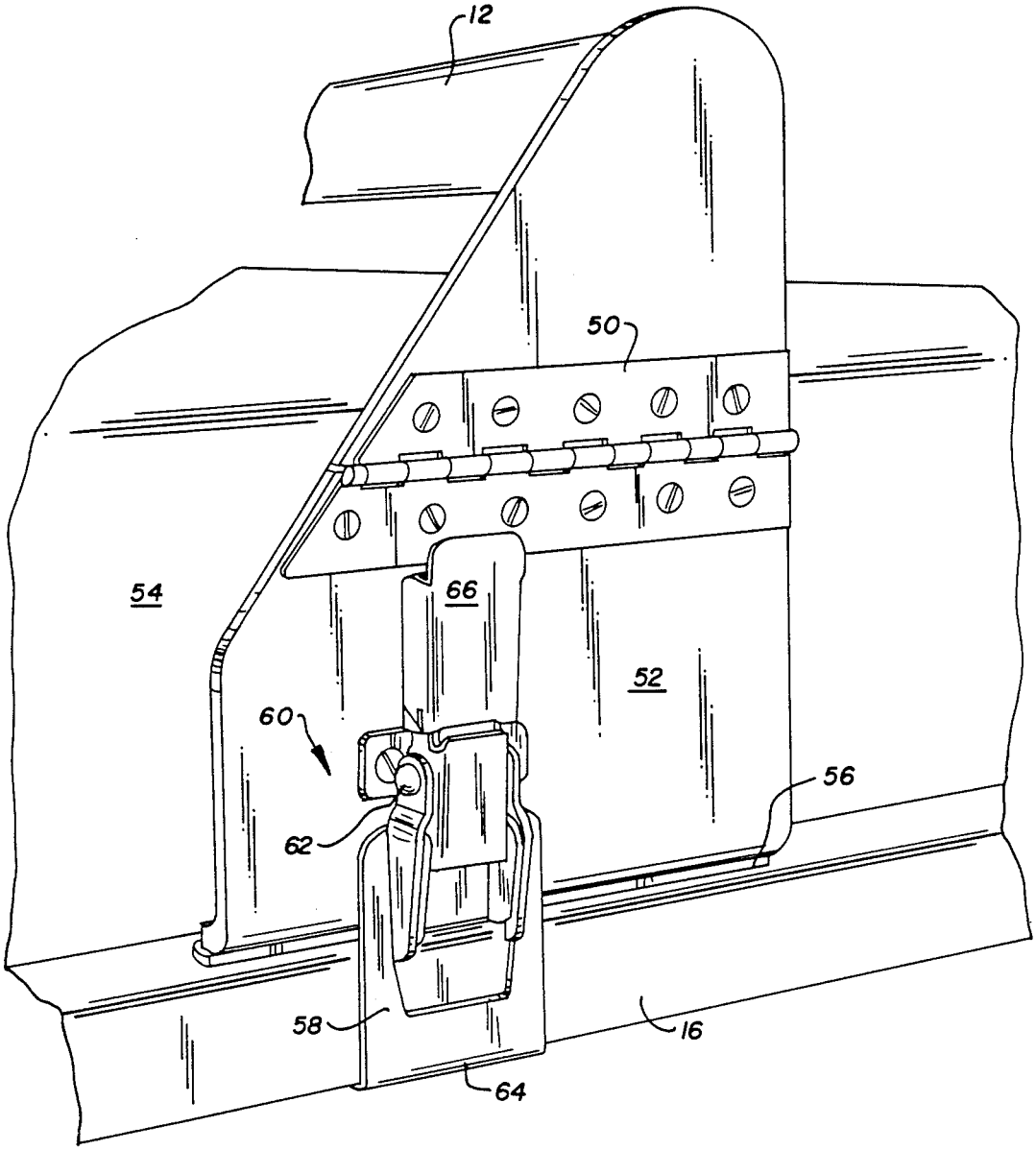
FIG. 5 is a perspective view showing a mounting plate in accordance with the present invention mounted to the rail of a bed in its locked configuration.

While the mounting plate 18 can be a unitary plate as shown in FIG. 1, the mounting plates provided in accordance with the present invention preferably include a hinge element 50 as shown in FIG. 3. The hinge 50 allows the plate 18 to be folded so that a lower plate portion 52 can easily clear the mattress 54 of the bed 14 during the attachment procedure. The lower portion 52 is then hinged downwardly so that the mounting plate 18 is substantially planar and is engaged with the upper surface of a bed rail 16 as shown in FIGS. 4 and 5. A rubber pad 56 or the like is preferably provided on the lowermost surface of the mounting plate 18 to engage the top of the bed rail 16. Further, the lower mounting plate is configured to permit adequate bearing on the rails as shown, for example, in FIG. 3.

Referring to FIGS. 3, 4, and 5 once the lower plate portion 52 is swung into position on the top of bed rail 16, the catch 58 of an overcenter latch mechanism 60 is pivoted about pivot pin 62 so that the catching portion 64 thereof is disposed under the bed rail edge. the latch 66 is then pivoted about pivot pin 68 to its closed position and installation of the mounting plate 18 to the bed rail 16 is then complete. The mounting plate on each end of the main body member has a substantially identical configuration and thus mounting of each end of the leg exercise device is substantially identical. If, however, one mounting plate is not hinged and the other is hinged, it is preferred that the nonhinged plate be clamped to the bed rail first followed by mounting and clamping the hinged plate.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims. For example, a motor driven mechanism could be provided to assist the pedaling exercise and/or a drag increasing brake element could be provided for engaging the pedal axle to vary the pedaling resistance.

What is claimed is:

1. An exercise device comprising:

an elongated main body member having a longitudinal axis and first and second longitudinal ends;

means for coupling each longitudinal end of said main body member to a frame of a bed so that said longitudinal axis of said elongated main body member is disposed substantially transverse to a longitudinal axis of the frame of the bed;

means for rotatably mounting first and second pedal crank arm elements to said main body member intermediate the longitudinal ends thereof for rotation in a plane substantially perpendicular to the longitudinal axis of the frame of the bed; and first and second pedal crank arm elements rotatably coupled to said means for mounting, said pedal crank arm elements being coupled to one another at proximal ends thereof by an axle portion so that longitudinal axes of said crank arm elements can be selectively offset at relative angles of 90 or 180°, said axle portion being rotatably coupled to said means for mounting whereby an individual lying on the bed can engage the pedal crank arm elements and can rotate the same relative to the main body member and the bed.

2. An exercise device as in claim 1, further including pedal elements mounted to a distal end of each of said crank arm elements.

3. An exercise device as in claim 1, wherein said means for mounting comprises a rod-like member coupled at a first end thereof to said main body member and defining a cylindrical element at a second end thereof for rotatably mounting said crank arm elements.

4. An exercise device as in claim 1, wherein said means for mounting is removably mounted to said main body member.

5. An exercise device as in claim 4, wherein said main body member includes an upwardly extending flange element having at least first and second apertures defined therethrough and said means for mounting includes a flange plate portion, said flange plate portion being mounted to said upwardly extending flange by nuts and bolts.

6. An exercise device as in claim 2, further including a plurality of strap elements coupled to each of said pedal elements for fastening a user's foot to said pedal elements.

7. An exercise device as in claim 1, wherein said means for coupling to a frame comprises first and second mounting plates fixedly mounted to first and second ends of said main body member, each said mounting plate including clamp means for clamping said mounting plate to the frame of a bed.

8. An exercise device as in claim 7, wherein said clamping means comprises an overcenter latch mechanism having a catching portion for engaging the frame of a bed.

9. An exercise device as in claim 7, wherein each said mounting plate includes upper and lower portions hingedly mounted together so that said lower portion is movable relative to said upper portion, said clamping means being mounted to said lower portion.

10. An exercise device comprising:

an elongated main body member;

means for coupling each end of said main body member to a frame of a bed, said means for coupling comprising first and second mounting plates fixedly mounted to first and second ends of said main body member, each said mounting plate including clamp means for clamping said mounting plate to the frame of a bed, said clamping means including an overcenter latch mechanism having a catching portion for engaging the frame of a bed;

means for rotatably mounting first and second pedal crank arm elements to said main body member;

first and second pedal crank arm elements rotatably coupled to said means for mounting, whereby an individual lying on the bed can engage the pedal crank arm elements and can rotate the same relative to the main body member and the bed.

11. An exercise device comprising:

an elongated main body member;

means for coupling each end of said main body member to a frame of a bed said means for coupling comprising first and second mounting plates fixedly mounted to first and second ends of said main body member, each said mounting plate including clamp means for clamping said mounting plate to the frame of a bed, each said mounting plate including upper and lower portions hingedly mounted together so that said lower portion is movable relative to said upper portion, said clamping means being mounted to said lower portion;

means for rotatably mounting first and second pedal crank arm elements to said main body member;

first and second pedal crank arm elements rotatably coupled to said means for mounting, whereby an individual lying on the bed can engage the pedal crank arm elements and can rotate the same relative to the main body member and the bed.

12. An exercise device comprising:

an elongated main body member having a longitudinal axis and first and second longitudinal ends;

means for coupling each longitudinal end of said main body member to a frame of a bed so that said longitudinal axis of said elongated main body member is disposed substantially transverse to a longitudinal axis of the frame of the bed;

means for rotatably mounting first and second pedal crank arm elements to said main body member intermediate the longitudinal ends thereof for rotation in a plane substantially perpendicular to the longitudinal axis of the frame of the bed, said means for rotatably mounting being removably mounted to said main body member, said main body member including an upwardly extending flange element having at least first and second apertures defined therethrough and said means for mounting includes a flange plate portion, said flange plate portion being mounted to said upwardly extending flange by nuts and bolts; and first and second pedal crank arm elements rotatably coupled to said means for mounting, whereby an individual lying on the bed can engage the pedal crank arm elements and can rotate the same relative to the main body member and the bed.

13. An exercise device as in claim 12, wherein said crank arm elements are coupled to one another at proximal ends thereof by an axle portion, said axle portion being rotatably coupled to said means for mounting.

14. An exercise device as in claim 13, wherein said means for mounting includes a substantially cylindrical element for receiving said axle portion.

15. An exercise device as in claim 12, wherein said means for coupling to a frame comprises first and second mounting plates fixedly mounted to first and second ends of said main body member, each said mounting plate including clamp means for clamping said mounting plate to the frame of a bed.

16. An exercise device as in claim 12, wherein said crank arm elements are coupled to one another at proximal ends thereof by an axle portion, said axle portion being rotatably coupled to said means for mounting.

17. An exercise device as in claim 16, wherein said means for mounting includes a substantially cylindrical element for receiving said axle portion.

18. An exercise device as in claim 16, wherein said crank arm elements are coupled to said axle portion so that longitudinal axes of said crank arm elements can be selectively offset at relative angles of 90 or 180°.

* * * * *